US005950290A

United States Patent [19]

Sear

[11] Patent Number: 5,950,290

[45] Date of Patent: Sep. 14, 1999

[54] JET FOR INTERLACING TEXTILE YARNS

[75] Inventor: Nicolas C. Sear, Winston-Salem, N.C.

[73] Assignee: International Machinery Sales, Inc., Winston-Salem, N.C.

[21] Appl. No.: 08/928,887

[22] Filed: Sep. 12, 1997

[51] Int. Cl.[6] ..... D02G 1/16

[52] U.S. Cl. ..... 28/272; 28/274

[58] Field of Search ..... 28/271, 272, 273, 28/274, 275, 276

[56] References Cited

U.S. PATENT DOCUMENTS

| | | | |
|---|---|---|---|
| 3,750,242 | 8/1973 | Lloyd et al. | 28/271 |
| 3,751,775 | 8/1973 | Psaras | 28/274 |
| 4,355,445 | 10/1982 | Matsumoto et al. . | |
| 4,430,780 | 2/1984 | Sear et al. . | |
| 4,507,833 | 4/1985 | Simmen . | |
| 4,557,026 | 12/1985 | Matsumoto et al. . | |
| 4,644,622 | 2/1987 | Bauer et al. | 28/272 |
| 4,679,284 | 7/1987 | Naylor et al. . | |
| 4,729,151 | 3/1988 | Runyon et al. . | |
| 4,841,606 | 6/1989 | Coons, III . | |
| 5,010,631 | 4/1991 | Ritter | 28/274 |
| 5,146,660 | 9/1992 | Ritter . | |
| 5,157,819 | 10/1992 | Hodan | 28/271 |
| 5,275,618 | 1/1994 | Koyfman et al. | 28/274 |
| 5,475,908 | 12/1995 | Scherpf et al. . | |
| 5,675,878 | 10/1997 | Brown et al. | 28/271 |
| 5,713,113 | 2/1998 | Demir | 28/274 |

FOREIGN PATENT DOCUMENTS

| | | |
|---|---|---|
| 0 088 254 A2 | 2/1983 | European Pat. Off. . |
| 0 140 526 A2 | 5/1985 | European Pat. Off. . |
| 0 532 458 A1 | 3/1993 | European Pat. Off. . |
| 0 338 980 B1 | 5/1993 | European Pat. Off. . |
| 0 564 400 B1 | 12/1995 | European Pat. Off. . |
| 2 093 872 | 9/1982 | United Kingdom . |

OTHER PUBLICATIONS

Heberlein–Key Components for Your Success (Sep. 1995).

*Primary Examiner*—John J. Calvert
*Assistant Examiner*—Larry D. Worrell, Jr.
*Attorney, Agent, or Firm*—Robert W. Pitts

[57] ABSTRACT

An air interlacing jet 2 includes a yarn channel 20 and a threading slot 42 forming an opening on one side of the yarn channel so that yarn or yarn filaments can be inserted into the yarn channel. An air orifice 40 intersects the yarn channel and high pressure air injected through the air inlet or orifice 40 interlaces or intertwines the yarn or yarn filaments as they are drawn through the yarn channel 20. The body 4 of the interlacing jet or jet insert 2 is a single piece member and the yarn channel 20 includes outwardly tapered sections 28 and 32 at each end. The tapered sections are formed by an EDM process. Thread guides 58, 60 located below the yarn channel axis and the tapered yarn channel sections permit the yarn to be drawn through the yarn channel 20 at an angle relative to the threading slot 42 so that the yarn cannot easily escape from the yarn channel 20. The air jets or jet inserts 2 can be positioned side by side in abutting relationship so that the jets can be positioned in close proximity to decrease the centerline spacing for adjacent yarns.

26 Claims, 6 Drawing Sheets

Fig. 6
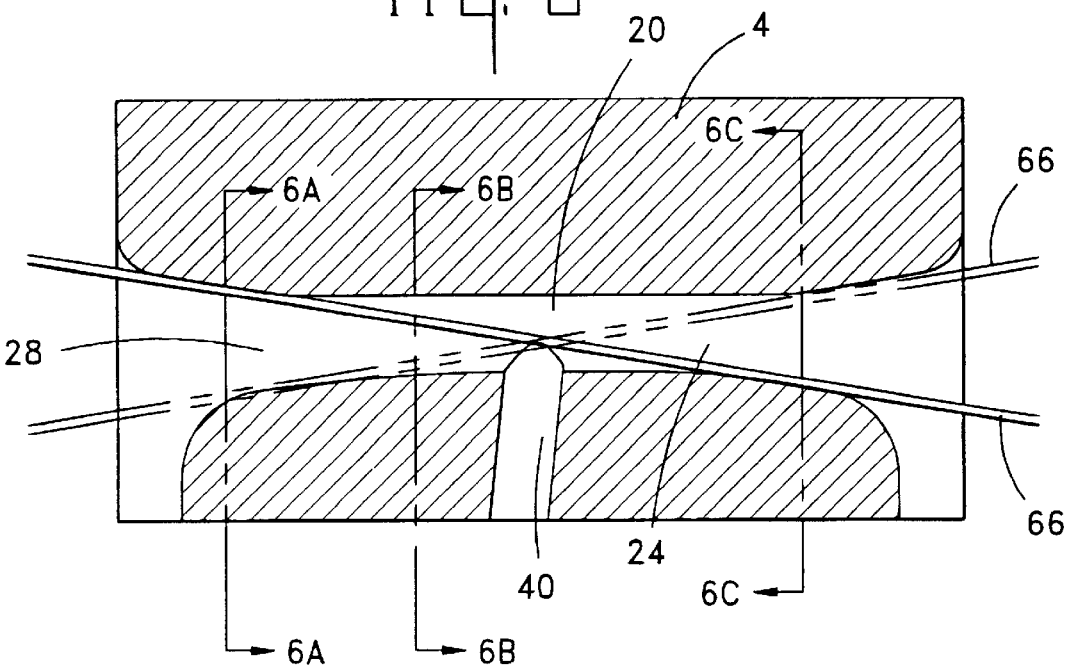
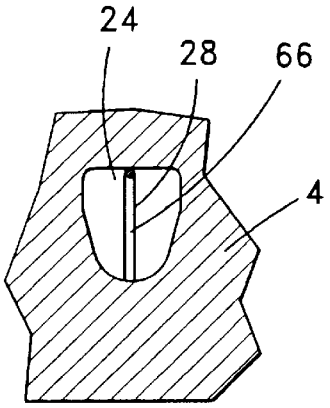
Fig. 6A
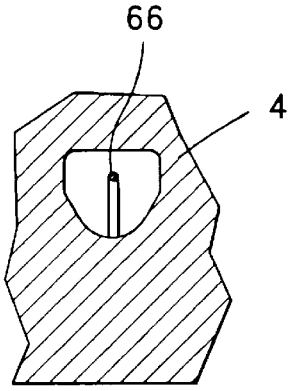
Fig. 6B
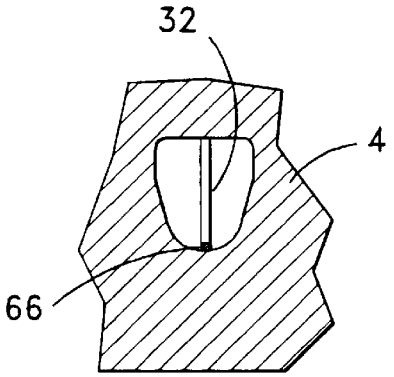
Fig. 6C

JET FOR INTERLACING TEXTILE YARNS

BACKGROUND OF THE INVENTION

1. Field of the Invention

This invention is related to the air intermingling, interlacing, commingling, or bulking of yarns or yarn filaments with an air jet. More specifically this invention is related to an interlacing jet in which the yarn or yarn filaments are subjected to a turbulent air stream as the yarn or yarn filaments pass through a channel into which high pressure air is injected.

2. Description of the Prior Art

A number of air jet configurations are used to interlace or bulk multifilament yarns. Both closed jet and open jet configurations have been used in prior art applications. The following patents show some of the air jets or air jet inserts that have been used in applications where air in injected into a yarn channel transverse to the axis of the channel and to the yarn.

U.S. Pat. No. 5,146,660 discloses a device for air-bulking multifilament yarn. This device has a two piece body formed by a nozzle unit and a baffle unit that are attached to form a yarn channel. When yarn is inserted in this yarn channel through a threading slot, air is injected through the nozzle unit to intermingle the multifilament yarn. Thread guides in the form of glued-in sapphire pins are inserted in the nozzle unit at both ends of the yarn channel. These thread guides position the yarn to maintain a minimum distance from the nozzle section.

U.S. Pat. No. 5,010,631 also discloses an air nozzle with a continuous yarn channel with an open treading slot. A baffle wall section opposed to a nozzle wall section is configured so that the air stream deflected by the baffle wall section does not enter the threading slot. The stated purpose for this configuration is to prevent filaments and filament bundles from being carried along with the airstream so that they will not impinge upon the edges of the threading slot and be damaged.

European Patentschrift 0 564 400 B1 discloses a device for intermingling multifilament yarns in which opposite walls of a yarn channel are convexly curved so that the distance between the two wall surfaces gradually increases from a minimum at the outlet of a jet nozzle toward both ends of the yarn channel. Thread guides are positioned at both ends of the yarn channel and both thread guides are at the same elevation so that the yarn cannot follow the curved surface of the yarn channel and the position of the yarn relative to a threading slot remains essentially constant along the axis of the yarn channel.

U.S. Pat. No. 4,430,780 discloses a fluid flow commingling jet having a threading slot that extends substantially tangentially relative to the yarn channel. A fluid flow pin is mounted on a plate having yarn guide located at one end of the yarn channel. The position of the fluid flow pin alters the fluid flow characteristics of the jet to produce a forwarding action. A prior art closed jet with a tapered yarn channel to cause air to flow in the direction in which the thread is moving is also described.

SUMMARY OF THE INVENTION

The air jet or air jet insert comprising the subject matter of this invention comprises a body having a yarn channel, an air inlet and a threading slot. The body comprises a unitary member that is fabricated from a single preformed block. Although the body is a single piece member, the yarn channel passing though the body has a relatively narrow central section an outwardly tapered yarn channel sections at each end. Thus although the body is a single piece member, the cross section of the yarn channel is greater on each end.

The preferred manner of fabricating this one piece member is to first form a blank and then to use an EDM process to form the yarn channel. The basic contour of the central section of the yarn channel is formed by an EDM wire moving parallel to the axis of the yarn channel. Thereafter the EDM wire is tilted relative to the axis of the yarn channel to form the outwardly tapered ends of the yarn channel in substantially one continuous operation.

Since the air jet is fabricated from a single piece, there is no need for complicated hardware to attach one air jet next to another similar jet. This air jet insert has mounting grooves on two sides, which can be viewed as the front and rear of the jet insert. Two jets can be placed in abutting relationship with opposed mounting grooves in alignment. A male mounting member can then be inserted into the hole formed by the abutting grooves so that the two jets can be secured together. Multiple jets can be positioned in abutting side by side relationship so that the centerlines between adjacent yarns can be closely spaced.

To position the yarn or the yarn filaments in the yarn channel an open threading slot is provided. This threading slot is straight and extends parallel to the axis of the yarn channel. The lower surfaces of the end sections of the yarn channel are inclined relative to the yarn channel axis and to the threading slot so that these lower surfaces are progressively spaced further below the threading slot upon movement toward the ends of the yarn channel. External thread guides are also positioned below the plane of the straight threading slot and in general alignment with the tapered lower surfaces of the yarn channel end sections. Therefore, the yarn can follow a path that diverges from the threading slot at each end of the yarn channel, reducing the tendency of the yarn to escape from the yarn channel when subjected to the turbulence developed within the air jet yarn channel.

BRIEF DESCRIPTION OF THE DRAWINGS

FIG. 6 is a view showing the path subsequently traveled by an EDM wire to form the outwardly tapered end sections of the yarn channel. FIGS. 6A, 6B, and 6C show the shape of the central and end sections of the yarn channel formed in this step.

DETAILED DESCRIPTION OF THE PREFERRED EMBODIMENT

Figure 1:
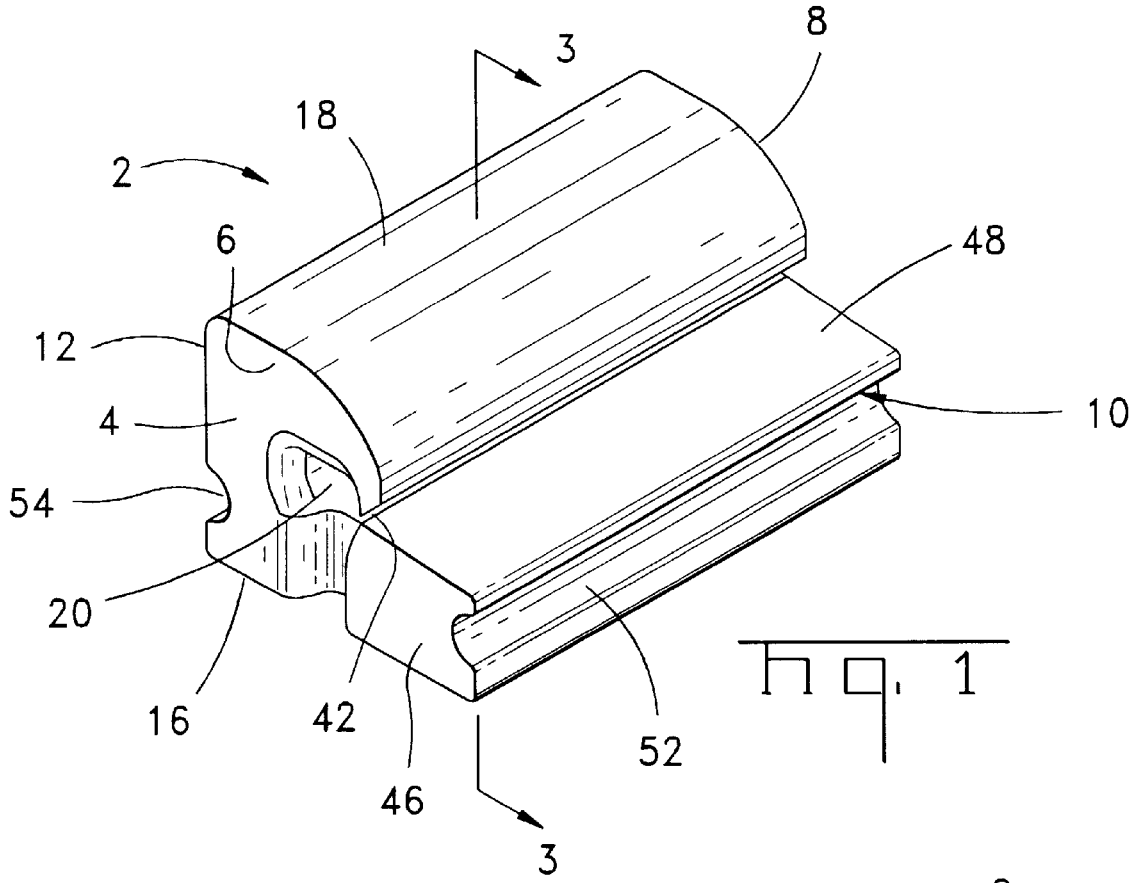
FIG. 1 is a three dimensional view of an interlacing jet showing the threading slot through which yarn can be inserted into a yarn channel

The preferred embodiment of the instant invention comprises a one piece jet or jet insert 2 that is used for interlacing, commingling or intermingling multiple filaments to form a yarn of intermingled fibers or filaments. This jet can also be used for air bulking multifilament yarns. The jet 2 has a single piece body 4 with a yarn channel 20 extending between opposite ends and an air inlet or orifice 40 communicating with the yarn channel 20. This jet 2 is an open jet with a threading slot 42 which opens into the front of the yarn channel 20 between the top and the bottom of the channel.

Figure 2:
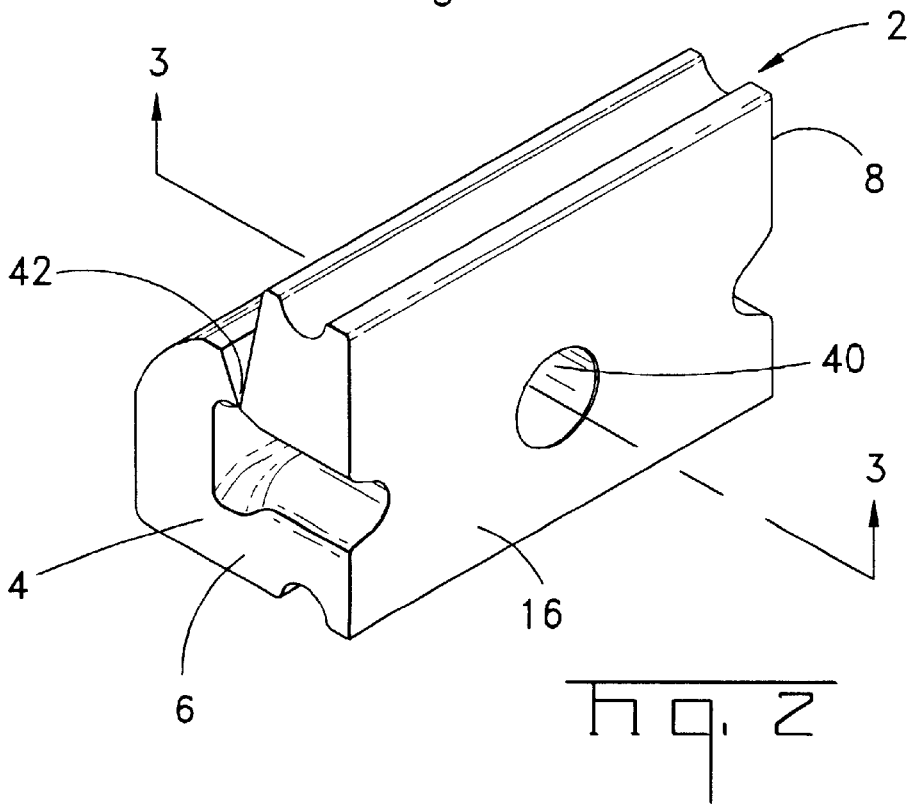
FIG. 2 is a three dimensional view of an interlacing jet showing the bottom surface through which the air inlet orifice extends.

FIGS. 1 and 2 show a single jet 2 from two different perspectives. FIG. 1 shows the jet from above, and the treading slot 42 can be seen to extend from a first end 6 of the body to a second end 8. FIG. 2 shows the jet from below, and the air inlet or orifice 40 is shown extending from the center of the bottom face 16 of the body toward the yarn channel 20. An air feed, not shown, can be connected to the air inlet 40, and high pressure air flows through the air inlet 40 into the channel 20. In the preferred embodiment, this configuration comprises a sonic nozzle.

The axis of the longitudinal yarn channel 20 extends between the first body end 6 and the second body end 8. A first or front side 10 extends between the two body ends and a second or rear side 12 extends not only between the two body ends 6 and 8, but also between the bottom face 16 and the top of the upper curved face 18.

Figure 3:
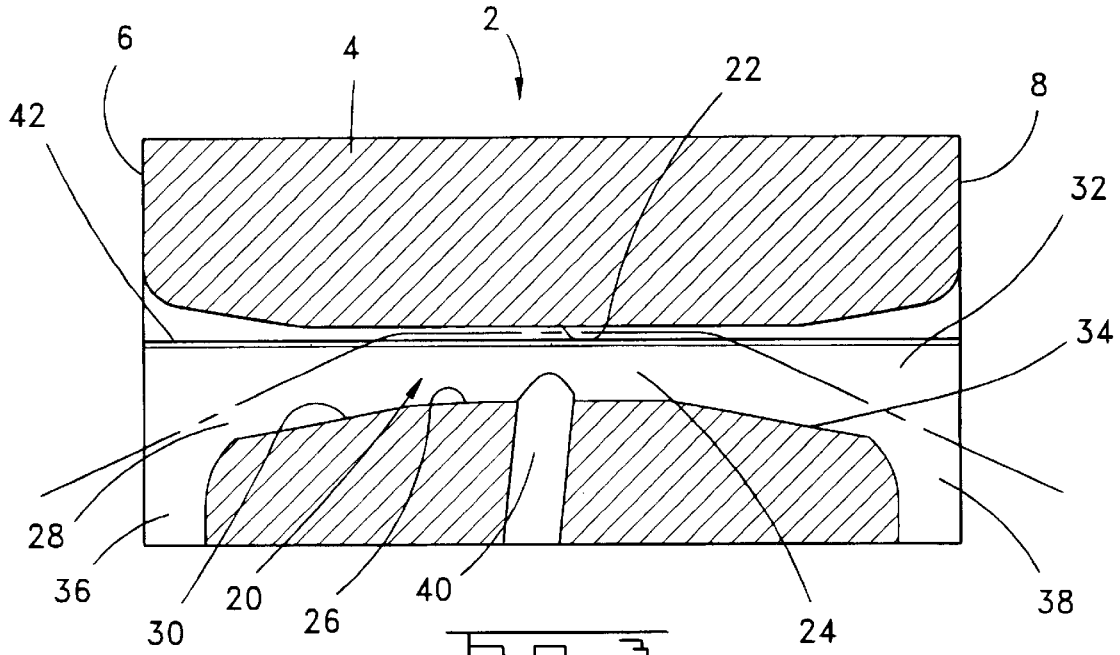
FIG. 3 is a section view taken through section lines 3—3 in FIGS. 1 and 2, showing the shape of the yarn channel and showing the position of the threading slot.

FIG. 3 shows a longitudinal section taken along section lines 3—3 shown in FIGS. 1 and 2. This view shows that the yarn channel 20 has three sections. The central yarn channel section 24 has a constant cross section and the air inlet 40 intersects this central section 24. The upper channel surface 22 extends through the central section 24. This upper surface 22 has flat sections with a smooth curved transition at each edge. The bottom surface 26 of the central yarn channel section 34 is curved, as shown in FIGS. 5A and 6B, and the air inlet 40 intersects the yarn channel 20 through this curved surface. The sidewalls of the central section are flat and the width of the yarn channel is constant between the flat top surface 22 and the curved lower surface 26. The threading slot 42 intersects one of these flat sidewalls and the width of the yarn channel 20 is the same both above and below the threading slot 40.

The yarn channel 20 also includes outwardly tapered end sections 28 and 32 that open onto the first body end 6 and the second body end 8 respectively. These end sections 28 and 32 are outwardly tapered because the cross sectional area of end sections 28 and 32 gradually increases between the yarn channel central section 24 and the body ends 6 and 8. The flat top surface 22 extends through both outwardly tapered end sections 28 and 32. The top surface can include a flat taper over a portion of the end sections. The tapered lower surface 30 of end section 28 is curved but extends at a steeper angle relative to the axis of the yarn channel 20 than the curved central section lower surface 26. Similarly, the tapered lower surface 34 of end section 32 is also curved (in cross section) and also extends at a steeper angle relative to the axis of the yarn channel 20 than the curved central section lower surface 26. Both end section lower surfaces 30 and 34 have the contour of a partial conical surface in that each lower surface is generated by a moving straight line extending through the respective channel end section. Since both end sections 28 and 32 are outwardly tapered, the cross section of the channel is wider at both ends than in the central section 24, and the yarn channel cannot be formed by a drill extending between the ends 6 and 8 of the body. The end section lower surfaces 30 and 34 also extend further below the straight threading slot 42 as the lower surface moves outward from the yarn channel central section 26 toward the ends of the yarn channel. In other words, the distance between each end channel lower surface 30 or 34 and the threading slot 42 is greater adjacent the respective body ends 6 and 8 than at the intersection between the yarn channel central section 26 and the respective yarn channel end section 28 and 32.

The tapered yarn channel end sections 28 and 32 also intersect right and left filets 36 and 38 on the ends of the body 4. These filets 36 and 38 are recesses in the body ends and the filets 36 and 38 extend from the yarn channel 20 to the bottom face 16 of body 4. The surface of these filets is in the form of a smooth curve and has a V-shape with a radiused vertex and radiused ends. The maximum width of these filets can be at least equal to the width of the yarn channel 20. The tapered or conical lower surfaces 30 and 34 of the yarn channel end sections 28 and 32 merge into these filets 36 and 38.

The air inlet 40 communicating with the yarn channel 20 is shown in FIG. 3. In the preferred embodiment, this air inlet 40 intersects the yarn channel central section 26. Although the air inlet or orifice 40 can be perpendicular to the yarn channel 20, the axis of the air inlet 40 can extend at an angle relative to the axis of the yarn channel 20. In the preferred embodiment, this angle would vary from five to ten degrees relative to the vertical. The axis of the air inlet 40 can be tilted either to the left or to the right for left or right feed so that different interlacing jets 2 can be used for applications in which the yarn traverses the yarn channel 20 in either direction. Air inlet 40 has a conical section that merges with a more restricted section leading to the yarn channel 20.

A continuous yarn or multiple yarn filaments can be inserted into the yarn channel 20 through the threading slot 42 which extends parallel to the axis of the yarn channel 20 between both ends of the body 4. The height of the threading slot 42 is sufficient to permit insertion of the yarn or yarn filaments, but the size of this slot 42 should not be too large or there could be a tendency for the yarn to escape from the yarn channel 20. As previously discussed, the lower surfaces of the yarn channel 20 progressively diverge from the threading slot 42 towards the ends of the body 4. This will permit the yarn to extend below the threading slot during operation of the interlacing jet 2 and the tendency of the yarn or yarn filaments to escape through the threading slot 42 will be decreased because the yarn would be held in place at least at the ends of the yarn channel.

Figure 7:
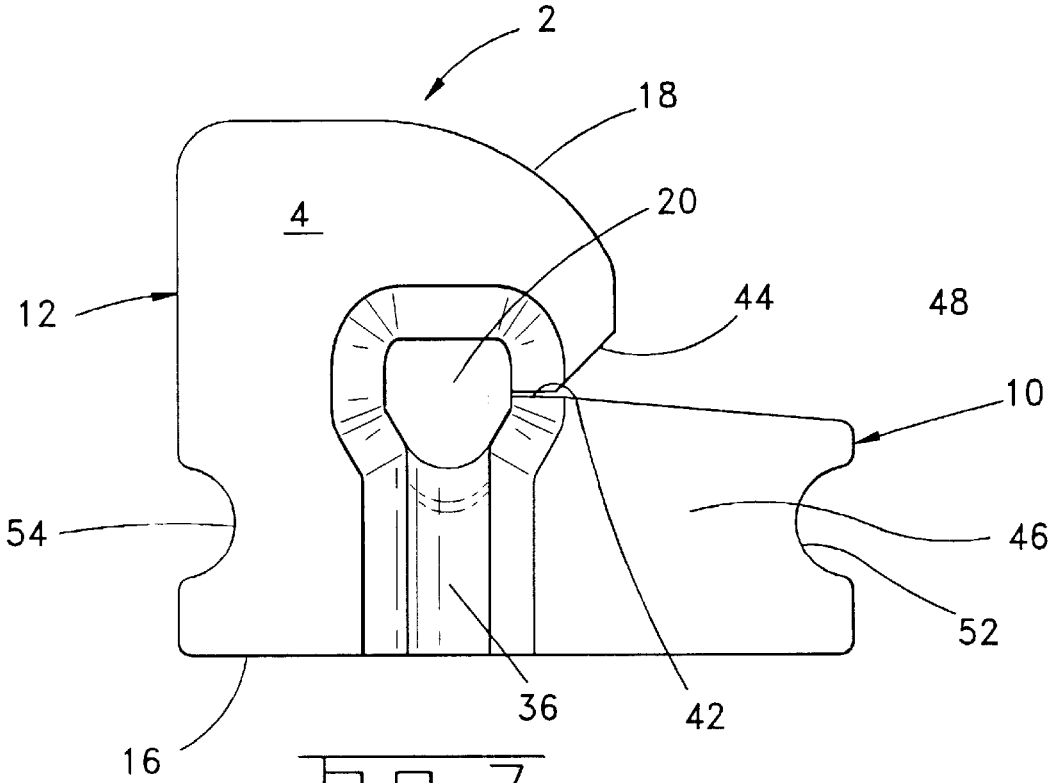
FIG. 7 is an end view of the jet showing one of the filets that intersect the yarn channel at each end.

The edges of the threading slot 42 adjacent the intersection of the threading slot 42 with the yarn channel 20, are parallel and define the minimum height of the threading slot 42. These edges of the threading slot 42 intersect a vertical wall of the yarn channel 20 and are not mutually offset at this point. This narrow section of the threading slot diverges at the outer opening of the threading slot 42 to form a tapered entrance 44, as best seen in FIG. 7, so that the yarn or yarn filaments can be easily inserted into the threading slot 42. The upper portion of this tapered entrance 44 is initially in the form of an inclined flat face which then merges with the curved top surface 18 of the body 4. The lower surface of threading slot 42 is coplanar with an upwardly facing surface 48 on a ledge 46 that extends laterally beyond the top surface of the body 4. This upper ledge surface 48 is inclined relative to the horizontal, and the surfaces forming the tapered entrance 44 subscribe an angle of approximately fifty degrees.

Mounting grooves 52 and 54 are formed on the sides of the body 4. This mounting grooves 52 and 54 are curved and each forms a semicircular surface facing outward. Each groove 52 and 54 is located adjacent to bottom of the body 4 and is equally spaced above the bottom face 16. When mounted side by side in abutting relationship, in the manner to be subsequently discussed, these grooves 52 and 54 will be located in an opposing relationship.

Figure 8:
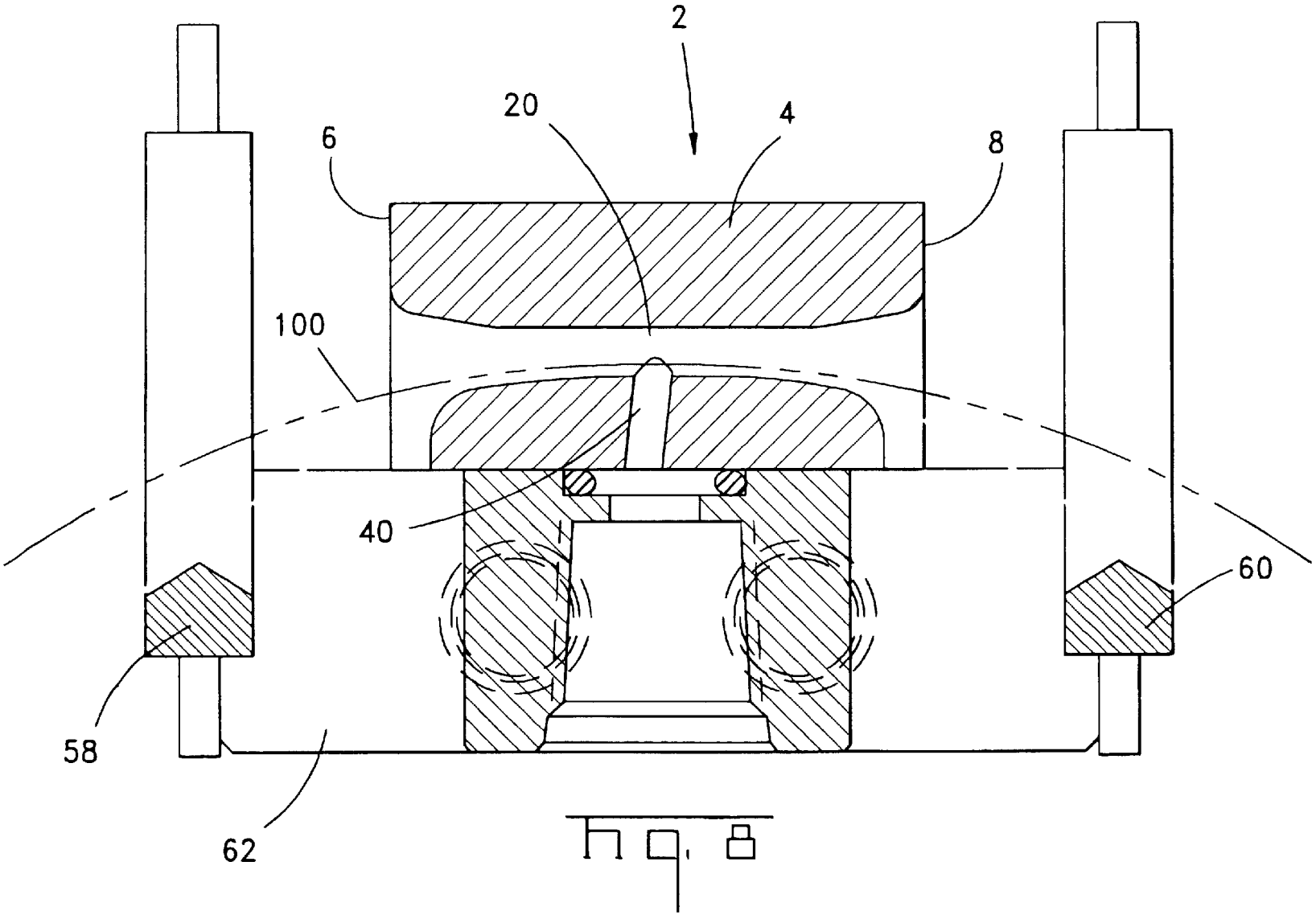
FIG. 8 is a view of the jet with a yarn guide bracket attached to the jet.

External guides 58 and 60 are shown in FIG. 8. These external guides 58 and 60 are spaced from the ends 6 and 8 of the body 4, and the guides are located in a plane extending through the axis of the yarn channel 20. However, each guide 58, 60 is positioned below the axis of the yarn channel 20 and below the threading slot 42. These external guides 58, 60 are positioned so that a line extending generally parallel to the tapered lower surfaces 30, 34 at the ends of the yarn channel 20 will intersect these yarn guides. This line corresponds generally to the path of the yarn 100 passing through the interlacing jet 2. When the yarn extending along the curved path 100 is positioned in the guides 58, 60, the yarn is held under tension and cannot escape from the yarn channel. Since the yarn path 100 must extend at a downward angle relative to the extended axis of the yarn channel 20 and relative to the horizontal plane of the threading slot 42, the yarn cannot escape from the yarn channel 20 through the threading slot 42. The external guides 58 and 60 are held in place by a guide bracket 62 that can be attached to the interlacing jet body 4. As shown in FIG. 8, the bracket 62 is attached to the back of the body 4 with the external guides 58 and 60 then being positioned beside the end faces 6 and 8.

Figure 9:
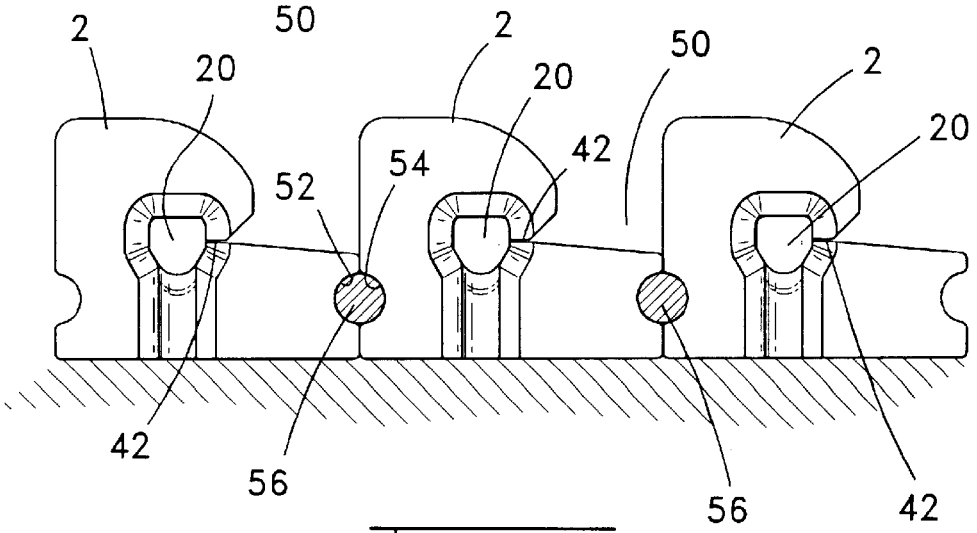
FIG. 9 is a view showing three separate jets attached side to side in close proximity.

FIG. 8 shows a single interlacing jet 2 with a guide bracket 62 for a single yarn or for filaments for forming a single interlaced yarn. The interlacing jets 2 can however be positioned side by side in a closely spaced configuration as shown in FIG. 9. When multiple jets 2 are positioned in this manner, the mounting grooves 52 and 54 are aligned and a single mounting pin 56 can be positioned between two jets to secure them in place. Stated differently, adjacent jets 2 can be positioned on either side of mounting pin or rod 56, which extends parallel to the yarn channel, with the mounting grooves 52 and 54 being positioned around the mounting rod 56. In other words, the rod 56 positions the adjacent jets 2. Two jets 2 on either side of a rod 56 are also held in place by the force exerted by an O-ring that fits between the air fitting and the air inlet of the jet so the mounting grooves 52, 54 are urged against the mounting rod 56. When held in this manner, jets 2 can be positioned so that the centerline between adjacent yarn paths will be on the order of 8 to 12 mm. This relatively close spacing provides an economical use of space. Even though the jets are closely spaced, there is still adequate room for lacing yarns or yarn filaments into through the threading slots 42 into the appropriate yarn channel. As shown in FIG. 9 a gathering area 50 is defined above the ledges 46 of each jet. The curved upper surface 18 of the body 4 provides a good lead in so that the yarn or yarn filaments can be laced downwardly into engagement with upper ledge surface 48 and then laterally through the threading slots 42 into the yarn channel. In order to position the yarn in the air jet yarn channel 20, either the tension on the yarn must be released or sufficient slack must be provided to permit the yarn or yarn filaments to be both threaded through the slot 42 and positioned in guides 58, 60. After the yarn or yarn filaments are in place, tension on the yarn causes it to maintain a inclination at both ends of the yarn channel so that the yarn cannot escape through the yarn channel. As high pressure air is injected through the orifice 40 the filaments forming the yarn are interlaced as the yarn moves through the yarn channel. For textured multifilament yarn the tension applied to the yarn also tends to prevent the knots formed in the kinky yarn by the jet from loosening as the yarn leaves the jet. The curved and tapered contour of the lower surface of the yarn channel will tend to reduce turbulence, and by keeping the yarn close to this surface, the yarn will in any event be subjected to less turbulent air which might tend to unravel the knots.

Figure 4:
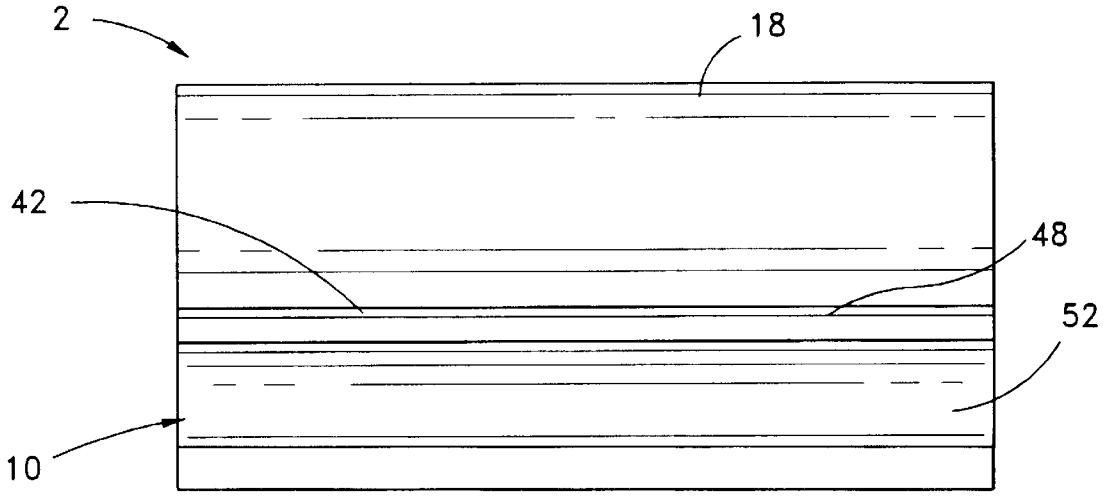
FIG. 4 is a side view showing the straight threading slot extending between ends of the jet.
Figure 5:
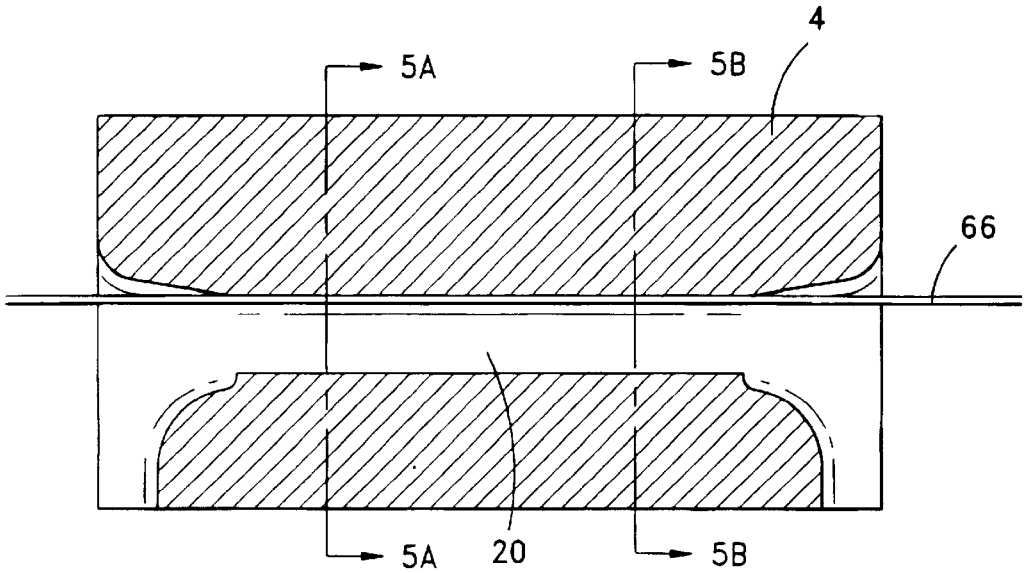
FIG. 5 is a view showing the path traveled by an EDM wire for initially forming a channel in the preformed blank of FIG. 4.
Figure 5A:
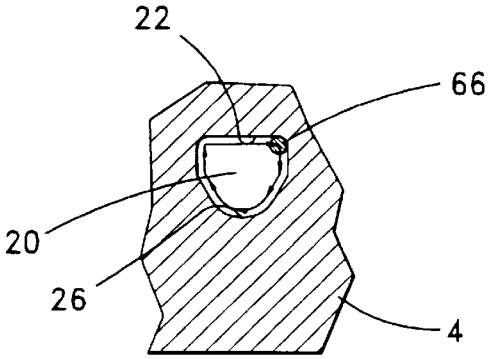
FIGS. 5A and 5B show the shape of the yarn channel formed in this step.
Figure 5B:
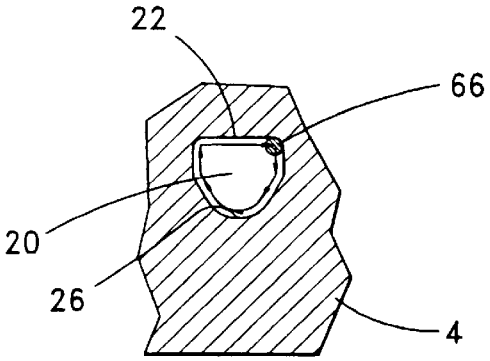

The body 4 is formed by a series of operations that are shown in part in FIGS. 5 and 6. In the preferred embodiment, the body 4 is formed from a material such as titanium carbonirtide. A preformed blank is formed by pressing the material into a preformed blank with punches. The basic contours of external features such as the curved upper surface 18, the ledge 46, the tapered threading slot entrance 44, the mounting grooves 52, 54 and the filets 36, 38 are formed in this step. The material is then sintered to form a preformed blank 64 substantially as shown in FIG. 4. After the preformed blank 64 has been sintered in a conventional manner, other features can be machined. As shown in FIGS. 5 and 6, an EDM wire 66 is first used to define the basic profile of the yarn channel 20 through the central yarn channel section 24. The flat upper surface 22 and the curved lower surface 26, as well as the straight side walls are formed by moving the EDM wire 66 along a path in which the EDM wire 66 remains parallel to the yarn channel axis as shown in FIG. 5. FIGS. 5A and 5B show that the cross section of the yarn channel remains constant between fileted ends during this step because the EDM wire 66 moves parallel to the yarn channel axis. The outwardly tapered end sections 28 and 32 are formed in the manner shown in FIG. 6. To form these outwardly tapered surfaces, each of which has a larger cross section than the yarn channel central section 26, the EDM wire 66 is tilted relative to the yarn channel axis to cut or machine the outwardly tapered lower surfaces 30 and 34 at opposite ends of the yarn channel 20. FIGS. 6A, 6B, and 6C show the formation of the outwardly tapered end sections 28 and 32 at opposite ends of the yarn channel as the EDM wire 66 moves along a path that is tilted relative to the yarn channel axis.

Although the preferred embodiment shows the use of a tapered lower surface of the yarn channel, other aspects of this invention can be used without tapering the lower surface. For example, the yarn guides could be aligned with the axis of the yarn channel, but the jets could still be positioned side by side in the manner shown herein. Furthermore the mounting means used with the preferred embodiment of this invention could be used with a two piece body in addition to its use with a single piece body. One of ordinary skill in the art would also realize that in addition to using the rods and grooves used in the preferred embodiment, interfitting tongues and grooves that are part of the jet body and which extend in the same direction could also be used. Therefore the preferred embodiment shown herein is merely representative, and the invention is defined by the claims presented herein.

I claim:

1. An interlacing jet for use in commingling textile fibers to form a yarn, the jet comprising:

a body;

a yarn channel extending through the body;

an air inlet communicating with the yarn channel;

a threading slot through which the yarn can be inserted into the yarn channel;

the jet being characterized in that the body is a unitary one-piece member, through which the yarn channel, the air inlet and the threading slot extend, and the yarn channel includes a yarn channel central section with a constant cross section and outwardly tapered end sections on opposite ends of the central section, the yarn channel being assymetric relative to the treading slot.

2. The interlacing jet of claim 1 wherein the yarn channel extends between first and second opposite ends of the body with the outwardly tapered yarn channel end sections opening onto the first and second opposite ends of the body; and wherein the threading slot extends between the first and second opposite ends of the body; and wherein the air inlet extends through the body from a face extending between the first and second ends of the body with the air inlet intersecting the yarn channel central section.

3. The interlacing jet of claim 1 wherein the body includes a ledge extending from one side of the body below the threading slot.

4. The interlacing jet of claim 1 wherein the body comprises a sintered titanium carbonitride member.

5. The interlacing jet of claim 1 wherein the body is formed from a preformed blank formed by pressing material between oppositely facing punches, wherein the yarn channel, the air inlet, the treading slot and the tapered yarn channel ends are machined in the body.

6. The interlacing jet of claim 5 wherein the tapered yarn channel ends are formed by an electric-discharge machining wire so that parallel projections of outwardly tapered lower surfaces on each end of the yarn channel do not intersect the body on opposite ends of the yarn channel.

7. The interlacing jet of claim 1 wherein the yarn channel comprises a central section formed by an EDM wire moving parallel to a yarn channel axis and opposite outwardly tapered yarn channel end sections formed by an EDM wire moving at an angle relative to the yarn channel axis.

8. The interlacing jet of claim 1 wherein the outwardly tapered yarn channel end sections each comprise conical surfaces generated by a straight line.

9. An interlacing jet for use in commingling textile fibers to form a yarn, the jet comprising:

a body having first and second sides;

a yarn channel extending through the body;

an air inlet communicating with the yarn channel;

a threading slot open on the first side of the body through which the yarn can be inserted into the yarn channel, and;

mounting means located on the first and second sides of the body and extending in the same direction as the yarn channel and the threading slot.

10. The interlacing jet of claim 9 wherein the mounting means comprises means for positioning an interlacing jet between interlacing jets located on opposite sides of the interlacing jet.

11. The interlacing jet of claim 9 wherein the mounting means comprises at least one female member on one side of the body means.

12. The interlacing jet of claim 11 wherein the mounting means includes grooves located on the first and second sides of the body means.

13. The interlacing jet of claim 12 wherein the interlacing jet is positioned adjacent to a second jet, the interlacing jet further comprising a male member received between grooves on adjacent jets to secure the adjacent jets together, the adjacent jets being aligned.

14. The interlacing jet of claim 9 further comprising a ledge extending from below the threading slot to the first side of the body means.

15. An assembly of interlacing jets positioned side by side in which each jet interlaces an individual textile yarn:

each jet comprising a body with first and second opposite sides;

each jet having a yarn channel extending between opposite ends of the body;

each jet also having a threading slot communicating with the yarn channel and opening toward and spaced from the first side of the body, and opening toward and spaced from the second side of an adjacent jet positioned therebeside to form a gathering area above the threading slot on each jet so that yarn can be inserted through the slot into the yarn channel of a corresponding jet with the yarns extending along closely spaced centerlines;

each jet also including mounting grooves on the first and second sides of the body, the mounting grooves extending parallel to the yarn channel with grooves on adjacent jets being juxtaposed and aligned;

and a rod extending through aligned grooves parallel to the yarn channel to hold adjacent jets side by side.

16. An interlacing jet for air intermingling multifilament yarn comprising:

a body;

a yarn channel extending between opposite ends of the body;

a threading slot extending laterally from the yarn channel and open at one end for insertion of a multifilament yarn into the yarn channel, the threading slot extending in a straight line between opposite ends of the body;

the jet being characterized in that the lower surface of the yarn channel is concave and inclined at opposite ends of the yarn channel so that a multifilament yarn extending through the yarn channel can be oriented, within the yarn channel, at an angle relative to the threading slot to limit any tendency of the yarn to escape through the yarn channel as air is injected into the yarn channel, the ends of the yarn channel being assymetric relative to the threading slot.

17. The interlacing jet of claim 16 wherein the inclined lower surfaces of the yarn channel extend below the threading slot.

18. The interlacing jet of claim 16 wherein a guide is positioned adjacent at least one end of the body, the guide being located below the elevation of the threading slot so that the yarn extends at an angle relative to the threading slot on at least one end of the yarn channel.

19. The interlacing jet of claim 18 wherein guides are located at both ends of the body beyond the ends of the yarn channel.

20. The interlacing jet of claim 16 wherein the body comprises a unitary one piece member in which the threading slot and the yarn channel are machined in the body.

21. The interlacing jet of claim 20 wherein the yarn channel is machined by an EDM wire.

22. The interlacing jet of claim 20 wherein the body includes mounting means on opposite sides thereof for mounting multiple jets in abutting relationship so that multiple yarn channels can be located on close spacings.

23. The interlacing jet of claim 16 wherein the yarn channel includes a central section having a constant cross section with the inclined sections at the opposite ends of the yarn channel both tapering outwardly so that the cross section of the yarn channel at each end is larger than the cross section in the central section.

24. The interlacing jet of claim 23 wherein an air inlet orifice communicates with the yarn channel central section.

25. An interlacing jet for air intermingling textured multifilament yarn comprising:

a body;

a yarn channel extending between an entrance and an exit at opposite ends of the body;

an air inlet entering the yarn channel to form knots in the textured multifilament yarn as the yarn passes through the yarn channel;

the jet being characterized in that the lower surface of the yarn channel is inclined at the exit of the yarn channel and yarn guides are located on opposite ends of the body below the yarn channel so that the yarn guides hold the multifilament yarn adjacent to the inclined lower surface at the exit of the yarn channel to prevent relaxation of the knots as the yarn exits the yarn channel.

26. The interlacing jet of claim 25 wherein the yarn guides hold the yarn under tension.

* * * * *